US010741937B2

(12) United States Patent
Miedl

(10) Patent No.: US 10,741,937 B2
(45) Date of Patent: Aug. 11, 2020

(54) CONNECTOR ARRANGEMENT

(71) Applicant: Rosenberger Hochfrequenztechnik GmbH & Co. KG, Fridolfing (DE)

(72) Inventor: Thomas Miedl, Garching (DE)

(73) Assignee: ROSENBERGER HOCHFREQUENZTECHNIK GMBH, Fridolfing (DE)

( * ) Notice: Subject to any disclaimer, the term of this patent is extended or adjusted under 35 U.S.C. 154(b) by 0 days.

(21) Appl. No.: 16/410,728

(22) Filed: May 13, 2019

(65) Prior Publication Data

US 2019/0363463 A1 Nov. 28, 2019

(30) Foreign Application Priority Data

May 25, 2018 (DE) ..... 10 2018 112 530

(51) Int. Cl.

| | |
|---|---|
| ***H01R 9/05*** | (2006.01) |
| ***H01B 7/02*** | (2006.01) |
| ***H01B 7/08*** | (2006.01) |
| ***H01R 13/6592*** | (2011.01) |
| ***H01R 103/00*** | (2006.01) |

(52) U.S. Cl.

CPC ..... *H01R 9/0518* (2013.01); *H01B 7/02* (2013.01); *H01B 7/0807* (2013.01); *H01R 13/6592* (2013.01); *H01R 2103/00* (2013.01)

(58) Field of Classification Search

CPC ..... H01R 4/646; H01R 4/188; H01R 9/0518; H01R 2103/00; H01R 13/6592; H01B 7/02; H01B 7/0807

USPC ..... 439/99, 585

See application file for complete search history.

(56) References Cited

U.S. PATENT DOCUMENTS

| | | | | | |
|---|---|---|---|---|---|
| 3,109,052 | A * | 10/1963 | Dumire | H01R 9/0503 | 174/88 C |
| 3,281,756 | A * | 10/1966 | O'Keefe | H01R 13/502 | 439/320 |
| 3,644,874 | A * | 2/1972 | Hutter | H01R 9/0518 | 439/322 |
| 3,646,502 | A * | 2/1972 | Hutter | H01R 13/621 | 439/322 |
| 5,536,184 | A * | 7/1996 | Wright | H01R 9/0518 | 439/578 |
| 6,257,920 | B1 | 7/2001 | Finona | | |
| 7,044,756 | B1 * | 5/2006 | Asakura | H01R 9/032 | 439/607.41 |
| 8,641,431 | B2 * | 2/2014 | Blasick | H01R 9/053 | 439/99 |
| 2004/0185707 | A1 * | 9/2004 | Holliday | H01R 9/0518 | 439/491 |

(Continued)

FOREIGN PATENT DOCUMENTS

JP 2010160957 A 7/2010

*Primary Examiner* — Gary F Paumen

(74) *Attorney, Agent, or Firm* — David P. Dickerson

(57) ABSTRACT

The present invention relates to a connector arrangement (100) with a connector (101) and a cable (50) connected to the connector, wherein the cable has an inner conductor (51) and an outer conductor (52) and the connector has an inner conductor (103) and an outer conductor (105), wherein the connector arrangement has a crimping region in which the cable is crimped with a crimp barrel (10), wherein the crimp barrel has at least one radially inwardly directed lug (11).

10 Claims, 2 Drawing Sheets

(56) References Cited

U.S. PATENT DOCUMENTS

| | | | | |
|---|---|---|---|---|
| 2008/0214049 | A1* | 9/2008 | Gump | H01R 9/0518<br>439/607.01 |
| 2017/0271784 | A1* | 9/2017 | De Cloet | H01R 4/20 |

* cited by examiner

CONNECTOR ARRANGEMENT

FIELD OF THE INVENTION

The present invention relates to a connector arrangement with a cable and a connector.

TECHNICAL BACKGROUND

In order to connect cables to connectors, it is known to press the cable and the connector in a connection region. In this case, the force with which the cable is pressed together with the connector has an effect on the mechanical holding force between the cable and the connector. It is problematic here that a pressing is associated with a deformation of the cable and the connector. This deformation has a disadvantageous effect on the electrical properties of a connector arrangement.

This is a state of affairs that needs improvement.

SUMMARY OF THE INVENTION

Against this background, the present disclosure aims to teach a connector arrangement with increased holding force between the cable and the connector and improved electrical properties of the connector arrangement.

Inter alia, the present disclosure teaches a connector arrangement with a connector and a cable connected to the connector, wherein the cable has an inner conductor and an outer conductor and the connector has an inner conductor and an outer conductor, wherein the connector arrangement has a crimping region in which the cable is crimped with a crimp barrel, wherein the crimp barrel has at least one radially inwardly directed lug.

The present disclosure moreover teaches a crimp barrel for a cable which has at least one radially inwardly directed lug.

The present disclosure furthermore teaches a cable, which has an inner conductor and an outer conductor, wherein the cable has a crimping region in which the cable is crimped with a crimp barrel, wherein the crimp barrel has at least one radially inwardly directed lug.

A lug has a relatively small diameter which is a few millimeters and/or, depending on the cable diameter, less than a tenth of the cable diameter.

The teaches of the present disclosure aim to increase the holding force of a connector on a cable by virtue of the fact that a crimp barrel is provided which interacts mechanically to a greater extent with the cable. This is achieved by a crimp barrel with one or more inwardly directed lugs. The lugs tend to be small so that they can easily come into engagement with a cable part which lies under them.

In this manner, the force with which a crimp barrel is pressed together with the cable can be reduced since the holding force is already increased as a result of the geometry of the crimp barrel or of the cable. This has a positive effect on the electrical properties of the connector arrangement since pressing is fundamentally disadvantageous for the electrical properties of a connector arrangement.

Advantageous configurations and further developments will become apparent from the description with reference to the figures of the drawing.

It will be obvious that the features indicated above and still to be explained below can be used not only in the respectively indicated combination, but rather also in other combinations or on their own without departing from the scope of the present invention.

In some embodiments, the lug is formed at a lateral end of the crimp barrel. "Lateral end" means that the lug bears against an edge of a lateral end of the crimp barrel. This enables a more angular contour of the lug in comparison with a lug which does not bear against an edge. If an angular lug is formed in a central region of a crimp barrel, ripping of the crimp barrel can arise. In comparison with this, a crimp barrel can deform more flexibly in a region of a lug if the lug bears against an edge of the crimp barrel. A crimp barrel with a more angular contour can interact more effectively mechanically with a cable. This increases the holding force of the crimp barrel on the cable.

In some embodiments, the crimp barrel has a plurality of lugs which are formed at opposing lateral ends of the crimp barrel. The holding force of a crimp barrel on a cable can thus be increased by virtue of the fact that several lugs interact mechanically with the cable. Depending on the number of lugs provided, a geometric deformation of the lugs or a deformation of the cable in a region of action of the lugs can have smaller dimensions. Electrical impairments as a result of a deformation of the cable can thus be reduced.

In some embodiments, the lug bears against the outer conductor of the cable, and in particular engages in a braided sheath of the cable. The interaction of the lug with an outer conductor of the cable is particularly advantageous. The interaction of a lug with a braided sheath or an outer conductor braiding of the cable is particularly effective since a lug can hook or cling particularly well into or onto a braiding of an outer conductor.

In some embodiments, the crimp barrel has at least one recess. The recess forms a window of the crimp barrel and enables an effective engagement of a cable part which lies below it.

In some embodiments, the braided sheath of the cable engages in the recess. A braided sheath particularly advantageously deforms during a crimping process by virtue of the fact that the braided sheath deforms into the recess.

In some embodiments, the crimp barrel is crimped with the outer conductor crimp. In this manner, a particularly effective crimping connection between a cable and a connector is ensured by means of a crimp barrel.

The above configurations and further developments can, where expedient, be combined with one another as desired. Further possible configurations, further developments and implementations of the invention also encompass combinations which are not explicitly cited of features of the invention described above and below in relation to the exemplary embodiments. In particular, a person skilled in the art will also add individual aspects as improvements or additions to the respective basic form of the present invention.

BRIEF DESCRIPTION OF THE DRAWINGS

The present invention is explained in greater detail below on the basis of the exemplary embodiments indicated in the schematic figures of the drawing. In the drawing.

Figure 1:
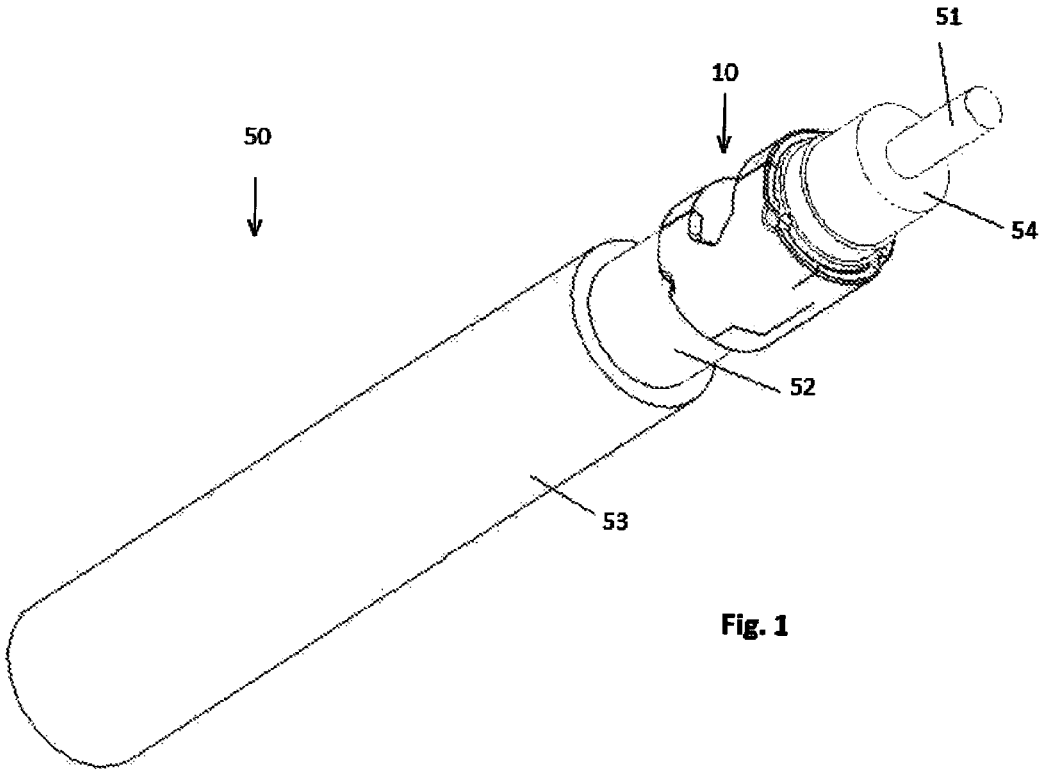
FIG. 1 shows a schematic perspective view of an embodiment of a cable according to the present disclosure.

The enclosed figures of the drawing are supposed to provide further understanding of the embodiments of the invention. They illustrate embodiments and serve in the context of the description to explain principles and concepts of the invention. Other embodiments and many of the stated advantages will become apparent in view of the drawings. The elements of the drawings are not necessarily shown true-to-scale in relation to one another.

In the figures of the drawing, identical, functionally identical elements, features and components and elements, features and components with the same effect—unless indicated otherwise—are provided in each case with the same reference number.

The figures are described coherently and comprehensively below.

DESCRIPTION OF EXEMPLARY EMBODIMENTS

FIG. 1 shows an embodiment of a cable 50 for crimping with a connector 101. Cable 50 has an outer conductor 52, an inner conductor 51, an insulating part 54, a sheathing 53 as well as a crimp barrel 10. The crimp barrel 10 is crimped to the outer conductor 52 of the cable 50. In a later assembly step, the crimp barrel 10 is furthermore crimped to an outer conductor crimp 106.

Figure 2:
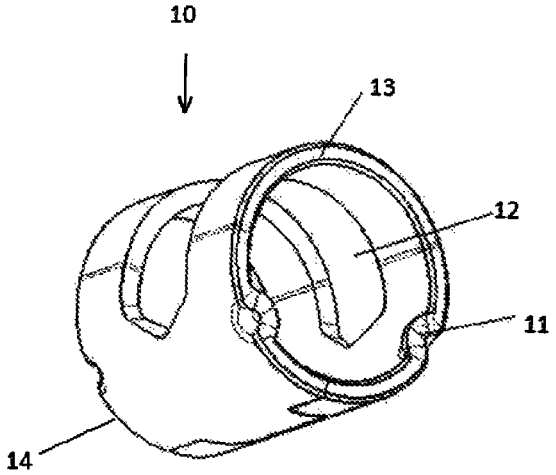
FIG. 2 shows a schematic perspective view of an embodiment of a crimp barrel according to the present disclosure.

FIG. 2 shows an embodiment of a crimp barrel 10 for crimping with a cable 50. The crimp barrel 10 has a recess 12 which forms an axially central window of the crimp barrel 10. The window extends approximately across a ⅔ circumference of the crimp barrel 10. The crimp barrel furthermore has a first lateral end 13 as well as a lateral end 14 opposite lateral end 13. At the lateral ends 13 and 14, the crimp barrel 10 has in each case two radially inwardly directed lugs 11. The lugs 11 are, measured on the total circumference of the crimp barrel 10, relatively small. As a result of the size of the lugs 11, they can hook into an outer conductor braiding of the outer conductor 52 without greater deformation effort. This increases the holding force of the crimp barrel 10 on the cable 50 with low mechanical deformation of the cable 50. Low mechanical deformation is desirable since mechanical deformations impair the electrical properties of a cable.

Figure 3:
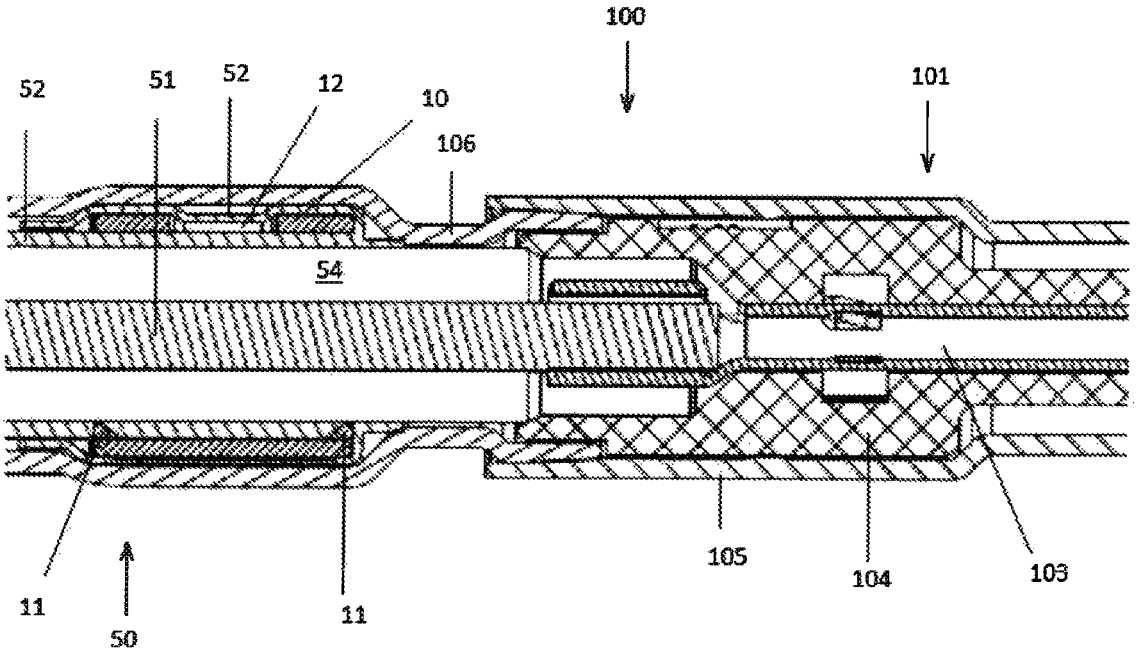
FIG. 3 shows a schematic perspective view of an embodiment of a connector arrangement according to the present disclosure.

FIG. 3 shows a connector arrangement 100 with a cable 50 and with a connector 101. The connector 101 has an outer conductor 105, an insulating part 104 and an inner conductor 103. The cable 50 and the connector 101 are crimped at various points with an outer conductor crimp 106 so that the cable 50 is fastened to the connector 101. The outer conductor crimp 106 is crimped with the outer conductor 105 of the connector 101.

It is apparent that the cable 50 was unsheathed in the region of the outer conductor crimp 106. I.e. the sheathing 53 of the cable was removed in this region. The crimp barrel 10 is also pushed on in the unsheathed region of the cable 50. The outer conductor braiding of the outer conductor 52 of the cable 50 was reversed or folded back over the crimp barrel 10. The outer conductor crimp 106 is crimped with the cable in the region of the crimp barrel 10. In the region in which the outer conductor braiding is folded over, the insulating part 54 and the inner conductor 51 are exposed. In this region, the insulating part 54 and the inner conductor 51 are surrounded by the outer conductor crimp 106 or by the outer conductor 105 of the connector 101.

Although the present invention has been described fully above on the basis of preferred exemplary embodiments, it is not restricted thereto, but rather can be modified in various manners.

The present disclosure may be summarized as disclosing, inter alia, the following Embodiments.

Embodiment 1

Connector arrangement (100) with a connector (101) and a cable (50) connected to the connector,
wherein the cable has an inner conductor (51) and an outer conductor (52) and the connector has an inner conductor (103) and an outer conductor (105),
wherein the connector arrangement has a crimping region in which the cable is crimped with a crimp barrel (10),
wherein the crimp barrel has at least one radially inwardly directed lug (11).

Embodiment 2

Connector arrangement according to Embodiment 1, wherein the lug is formed at a lateral end (13; 14) of the crimp barrel.

Embodiment 3

Connector arrangement according to Embodiment 2, wherein the crimp barrel has a plurality of lugs which are formed at opposing lateral ends (13, 14) of the crimp barrel.

Embodiment 4

Connector arrangement according to any one of the preceding Embodiments, wherein the lug bears against the outer conductor of the cable and in particular engages in a braided shield of the cable.

Embodiment 5

Connector arrangement according to any one of the preceding Embodiments, wherein the crimp barrel has at least one recess (12).

Embodiment 6

Connector arrangement according to Embodiment 5, wherein the outer conductor of the cable, in particular the braided shield, engages in the recess.

Embodiment 7

Connector arrangement according to Embodiment 5 or 6, wherein the crimp barrel is crimped with the braided shield and the braided shield is within the crimp barrel.

Embodiment 8

Connector arrangement according to any one of the preceding Embodiments, wherein the crimp barrel is crimped with an outer conductor crimp (106) and the outer conductor crimp is crimped with an outer conductor of the connector.

Embodiment 9

Crimp barrel (10) for a cable which has at least one radially inwardly directed lug (11).

Embodiment 10

Cable (50) which has an inner conductor (51) as well as an outer conductor (52), wherein the cable has a crimping region, in which the cable is crimped with a crimp barrel (10), wherein the crimp barrel has at least one radially inwardly directed lug (11).

LIST OF REFERENCE NUMBERS

10 Crimp barrel
11 Lug
12 Recess
13 Lateral end
14 Lateral end
50 Cable
51 Inner conductor
52 Outer conductor
53 Sheathing
54 Insulating part
100 Connector arrangement
101 Connector
103 Inner conductor
104 Insulating part
105 Outer conductor
106 Outer conductor crimp

The invention claimed is:

1. A connector arrangement, comprising:
a connector;
a cable connected to said connector; and
a crimp barrel crimped to said cable, wherein
said cable comprises an inner conductor and an outer conductor,
said connector comprises an inner conductor and an outer conductor,
said crimp barrel comprises at least one radially inwardly projecting lug, and
said at least one lug comprises a first lug located at a first edge at a lateral end of said crimp barrel.

2. The connector arrangement of claim 1, wherein:
said at least one lug comprises a second lug located at a second edge at a second lateral end of said crimp barrel.

3. The connector arrangement of claim 1, wherein:
said outer conductor of said cable comprises a braided shield, and
said at least one lug bears against said outer conductor of said cable and engages said braided shield.

4. The connector arrangement of claim 3, wherein:
said crimp barrel comprises at least one recess, and
said braided shield engages said at least one recess.

5. The connector arrangement of claim 3, wherein:
said crimp barrel is crimped with said braided shield, and
a portion of said braided shield is situated within the crimp barrel.

6. The connector arrangement of claim 1, wherein:
said crimp barrel comprises at least one recess.

7. The connector arrangement of claim 6, wherein:
said outer conductor of said cable engages said at least one recess.

8. The connector arrangement of claim 1, comprising:
an outer conductor crimp, wherein
the crimp barrel is crimped with said outer conductor crimp, and
said outer conductor crimp is crimped with said outer conductor of said connector.

9. A cable assembly, comprising:
a cable, and
a crimp barrel crimped to said cable, wherein
said cable comprises an inner conductor and an outer conductor,
said crimp barrel comprises at least one radially inwardly projecting lug, and
said at least one lug comprises a first lug located at a first edge at a first lateral end of said crimp barrel.

10. The cable assembly of claim 9, wherein:
said at least one lug comprises a second lug located at a second edge at a second lateral end of said crimp barrel.

* * * * *